US007866396B2

(12) United States Patent
Rytlewski

(10) Patent No.: US 7,866,396 B2
(45) Date of Patent: Jan. 11, 2011

(54) SYSTEMS AND METHODS FOR COMPLETING A MULTIPLE ZONE WELL

(75) Inventor: Gary L. Rytlewski, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 731 days.

(21) Appl. No.: 11/308,999

(22) Filed: Jun. 6, 2006

(65) Prior Publication Data

US 2008/0000697 A1 Jan. 3, 2008

(51) Int. Cl.
*E21B 34/14* (2006.01)

(52) U.S. Cl. ..... 166/313; 166/373; 166/332.4

(58) Field of Classification Search ..... 166/313, 166/373, 386, 153, 154, 155, 156, 193, 194, 166/318, 332.4
See application file for complete search history.

(56) References Cited

U.S. PATENT DOCUMENTS

| | | | | |
|---|---|---|---|---|
| 2,249,511 | A * | 7/1941 | Westall | 166/291 |
| 2,493,650 | A * | 1/1950 | Baker et al. | 166/194 |
| 3,054,415 | A * | 9/1962 | Baker et al. | 137/68.16 |
| 3,542,130 | A | 11/1970 | Stout | |
| 4,991,653 | A | 2/1991 | Schwegman | |
| 5,029,644 | A | 7/1991 | Szarka et al. | |
| 5,361,856 | A | 11/1994 | Surjaatmadja et al. | |
| 5,765,642 | A | 6/1998 | Surjaatmadja | |
| 5,890,537 | A | 4/1999 | Lavaure et al. | |
| 6,286,599 | B1 | 9/2001 | Surjaatmadja et al. | |
| 6,333,699 | B1 | 12/2001 | Zierolf | |
| 6,386,288 | B1 | 5/2002 | Snider et al. | |
| 6,464,008 | B1 | 10/2002 | Roddy et al. | |
| 6,474,421 | B1 | 11/2002 | Stoesz | |
| 6,536,524 | B1 | 3/2003 | Snider | |

(Continued)

FOREIGN PATENT DOCUMENTS

WO 2005090742 A1 9/2005

OTHER PUBLICATIONS

Thomson, D.W. and Nazroo, M.F.: "Design and Installation of a Cost-Effective Completion System for Horizontal Chalk Wells Where Multiple Zones Require Acid Stimulation," SPE 51177 Drilling & Completion, Offshore Technology Conference, Sep. 1998, pp. 151-156.

*Primary Examiner*—William P Neuder
*Assistant Examiner*—David Andrews
(74) *Attorney, Agent, or Firm*—Rodney V. Warfford; Trop, Pruner & Hu, P.C.

(57) ABSTRACT

A system for use in a wellbore having a plurality of well zones includes a tubing disposed in the wellbore; and a plurality of valves connected to the tubing, wherein each of the plurality of valves comprises at least one port for communication between the tubing and one of the plurality of well zones, wherein each of the plurality of valves further comprises a sleeve moveable by an actuating device between an open position, wherein the at least one port is open, and a closed position, wherein the at least one port is closed, wherein the actuating device comprises a head part and a tail part, the head part having a disk-like or partial spherical structure having a diameter slightly smaller than an internal diameter of the tubing and the tail part having at least one fin arranged substantially perpendicular to the disk-like or partial spherical structure.

17 Claims, 7 Drawing Sheets

U.S. PATENT DOCUMENTS

| | | | | |
|---|---|---|---|---|
| 6,662,874 | B2 | 12/2003 | Surjaatmadja et al. | |
| 6,719,054 | B2 | 4/2004 | Cheng et al. | |
| 6,723,933 | B2 | 4/2004 | Haag et al. | |
| 6,759,968 | B2 | 7/2004 | Zierolf | |
| 6,761,219 | B2 | 7/2004 | Snider et al. | |
| 6,907,936 | B2 | 6/2005 | Fehr et al. | |
| 2002/0007949 | A1 | 1/2002 | Tolman et al. | |
| 2002/0093431 | A1 | 7/2002 | Zierolf | |
| 2002/0158120 | A1 | 10/2002 | Zierolf | |
| 2003/0090390 | A1 | 5/2003 | Snider et al. | |
| 2003/0127227 | A1* | 7/2003 | Fehr et al. | 166/306 |
| 2004/0007361 | A1* | 1/2004 | McGarian et al. | 166/319 |
| 2004/0040707 | A1 | 3/2004 | Dusterhoft et al. | |
| 2004/0118564 | A1 | 6/2004 | Themig et al. | |
| 2004/0129422 | A1 | 7/2004 | Themig | |
| 2005/0173126 | A1 | 8/2005 | Starr et al. | |
| 2005/0178552 | A1 | 8/2005 | Fehr et al. | |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2006/0243455 | A1* | 11/2006 | Telfer et al. | 166/386 |

* cited by examiner

SYSTEMS AND METHODS FOR COMPLETING A MULTIPLE ZONE WELL

CROSS REFERENCE TO RELATED APPLICATIONS

This is related to a co-pending U.S. patent application Ser. No. 10/905,073, filed on Dec. 14, 2004 entitled "System for Completing Multiple Well Intervals."

BACKGROUND OF THE INVENTION

1. Field of the Invention

The invention relates generally to systems and methods recovery of hydrocarbons in subterranean formations. In particular, embodiments of the present invention relate to methods and systems for delivering treatment fluids to wells having multiple production zones.

2. Background Art

In typical wellbore operations, various treatment fluids may be pumped into the well and eventually into the formation to restore or enhance the productivity of the well. For example, a non-reactive "fracturing fluid" or a "frac fluid" may be pumped into the wellbore to initiate and propagate fractures in the formation thus providing flow channels to facilitate movement of the hydrocarbons to the wellbore so that the hydrocarbons may be pumped from the well. In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e., oil, gas or water) into the wellbore. In another example, a reactive stimulation fluid or "acid" may be injected into the formation. Acidizing treatment of the formation results in dissolving materials in the pore spaces of the formation to enhance production flow.

Currently, in wells with multiple production zones, it may be necessary to treat various formations in a multi-staged operation requiring many trips downhole. Each trip generally consists of isolating a single production zone and then delivering the treatment fluid to the isolated zone. Since several trips downhole are required to isolate and treat each zone, the complete operation may be very time consuming and expensive.

Accordingly, there exists a need for systems and methods to deliver treatment fluids to multiple zones of a well in a single trip downhole.

SUMMARY OF THE INVENTION

One aspect of the invention relates to systems for use in a wellbore having a plurality of well zones. A system in accordance with one embodiment of the invention includes a tubing disposed in the wellbore; and a plurality of valves connected to the tubing, wherein each of the plurality of valves comprises at least one port for communication between the tubing and one of the plurality of well zones, wherein each of the plurality of valves further comprises a sleeve moveable by an actuating device between an open position, wherein the at least one port is open, and a closed position, wherein the at least one port is closed, wherein the actuating device comprises a head part and a tail part, the head part having a disk-like or partial spherical structure having a diameter slightly smaller than an internal diameter of the tubing and the tail part having at least one fin or void arranged substantially perpendicular to the disk-like or partial spherical structure.

In another aspect, embodiments disclosed herein relate to methods for treating a wellbore having a plurality of well zones. A method in accordance with one embodiment of the invention includes disposing a tubing in the wellbore, wherein the tubing has a plurality of valves, each having at least one port for communication between the tubing and one of the plurality of well zones, wherein each of the plurality of valves further comprises a sleeve moveable between an open position, wherein the at least one port is open, and a closed position, wherein the at least one port is closed; opening a first valve of the plurality of valves by moving a sleeve therein using an actuating device, wherein the actuating device comprises a head part and a tail part, the head part having a disk-like or partial spherical structure having a diameter slightly smaller than an internal diameter of the tubing and the tail part having at least one fin arranged substantially perpendicular to the disk-like or partial spherical structure, wherein the disk-like or partial spherical structure is configured to push a seating member on the sleeve to cause the opening of the first valve; and flowing a fluid through the first valve.

Another aspect of the invention relates to methods for flowing a fluid uphole from a wellbore having a plurality of well zones. A method in accordance with one embodiment of the invention includes disposing a tubing in the wellbore, wherein the tubing has a plurality of valves, each having at least one port for communication between the tubing and one of the plurality of well zones, wherein each of the plurality of valves further comprises a sleeve moveable between an open position, wherein the at least one port is open, and a closed position, wherein the at least one port is closed; opening at least one valve of the plurality of valves by moving a sleeve therein using an actuating device, wherein the actuating device comprises a head part and a tail part, the head part having a disk-like or partial spherical structure having a diameter slightly smaller than an internal diameter of the tubing and the tail part having at least one fin arranged substantially perpendicular to the disk-like or partial spherical structure, wherein the disk-like or partial spherical structure is configured to push a seating member on the sleeve to cause the opening of the at least one valve; and flowing the fluid through the at least one valve into the tubing and uphole, wherein the tubing has at least one section having an enlarged inner diameter such that the fluid can flow by the disk-like or partial spherical structure.

Other aspects and advantages of the invention will become apparent from the following description and the attached claims.

DETAILED DESCRIPTION

Embodiments of the invention relate to control device for use in systems for completing multi-zone wells. Conventionally, multi-zone wells are completed in stages (multiple trips downhole) that result in very long completion times (e.g., on the order of four to six weeks). Embodiments of the present invention may reduce such completion time to a few days, by facilitating multi-zone completions in a single trip.

Figure 1:
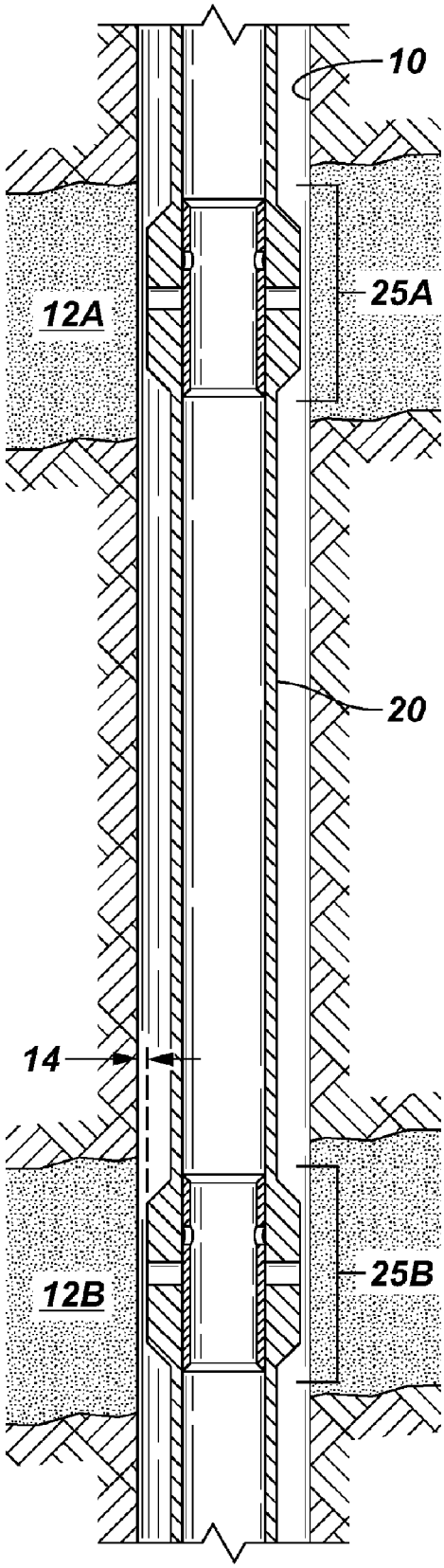
FIG. 1 shows a completion system having multiple valves for use in treating multiple zone formations.

FIG. 1 illustrates a typical well completion system disposed in a wellbore 10. The wellbore 10 may include a plurality of well zones (e.g., formation, production, injection, hydrocarbon, oil, gas, or water zones or intervals) 12A, 12B. The completion system includes a casing 20 having one or more zonal communication valves 25A, 25B arranged to correspond with individual formation zones 12A, 12B. The zonal communication valves 25A, 25B function to regulate hydraulic communication between the axial bore of the casing 20 and the respective formation zone 12A, 12B. For example, to deliver a treatment fluid to formation zone 12B, valve 25B is opened and valve 25A is closed. Therefore, any treatment fluid delivered into the casing 20 from the surface will be delivered to zone 12B and bypass zone 12A. The valves 25A, 25B of the well completion system may include any type of valve or various combinations of valves including, but not limited to, sliding or rotating sleeve valves, ball valves, flapper valves and other valves. Furthermore, while this example describes a completion system including control valves in a casing, embodiments of the invention may use any tubular string, including a casing, a liner, a tube, a pipe, or other tubular member.

A well completion system, such as that shown in FIG. 1, may be deployed in an open (uncased) borehole as a temporary or permanent completion. In this case, sealing mechanisms (e.g., packers) may be used to isolate the zone to be treated Alternatively, the valves and casing of a completion system may be cemented in place as a permanent completion. In this case, the cement serves to isolate each formation zone, and no packer is needed.

Figure 2A:
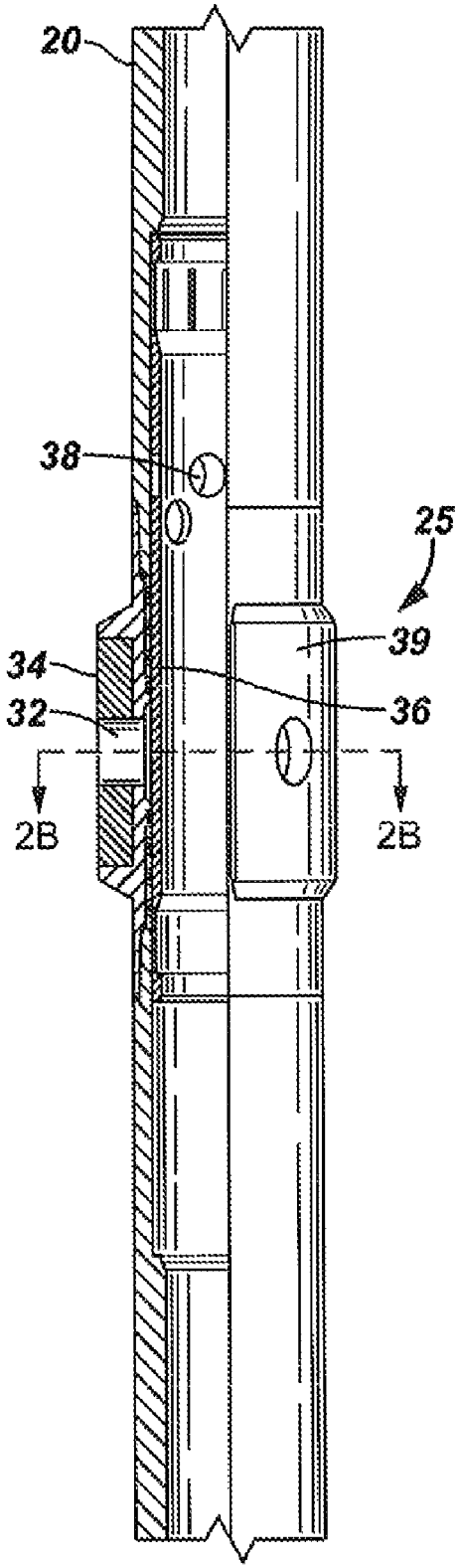
FIGS. 2A and 2B show a control valve for use in a completion system such as that shown in FIG. 1.
Figure 2B:
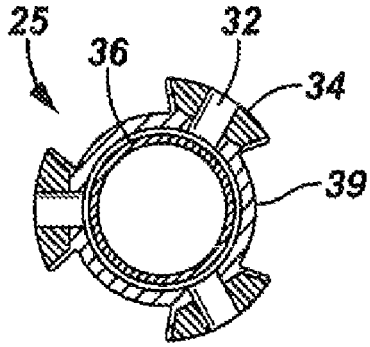

Embodiments of the invention may use any kind of valves (such as ball valves and sleeve valves) to control fluid flows. FIGS. 2A and 2B illustrate an embodiment of a zonal communication valve 25. The valve 25 includes an outer housing 39 having an axial bore therethrough. The housing 39 may be connected to or integrally formed with a casing 20 (or other tubular string). The housing 39 has a set of housing ports 32 formed therein for establishing communication between the wellbore and the axial bore of the housing.

In some embodiments, the housing 39 also includes a set of "lobes" or protruding elements 34 through which the ports 32 are formed. Each lobe 34 protrudes radially outward to minimize the gap 14 between the valve 25 and wellbore 10 (as shown in FIG. 1), yet cement may still flow through the recesses between the lobes during cementing-in of the casing. By minimizing the gap 14 between the lobes 34 and the formation, the amount of cement interfering with communication via the ports 32 is also minimized. A sleeve 36 is arranged within the axial bore of the housing 39. The sleeve 36 is moveable between: (1) an "open port position," whereby a flowpath is maintained between the wellbore and the axial bore of the housing 39 via the set of ports 32, and (2) a "closed port position" whereby the flowpath between the wellbore and the axial bore of the housing 39 via the set of ports 32 is obstructed by the sleeve 36.

Figure 7:
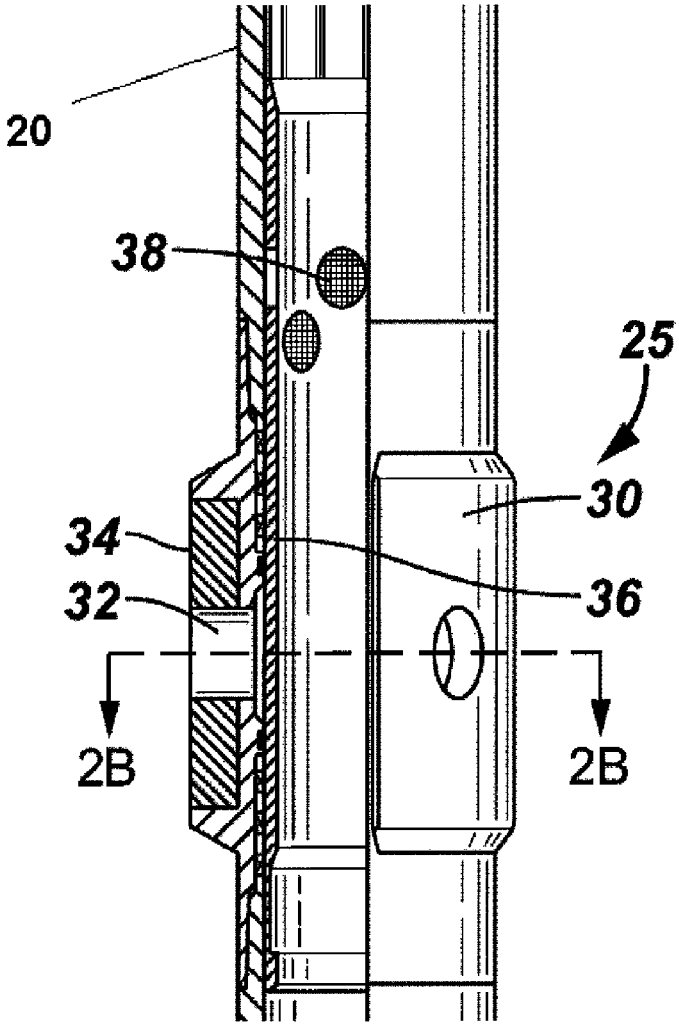
FIG. 7 shows a control valve for use in a completion system such as that shown in FIG. 1.

In some embodiments, the sleeve 36 may include a set of sleeve ports 38, which are aligned with the set of ports 32 of the housing 39 in the open port position, but not in the closed port position. In some embodiments, such as the embodiment shown in FIG. 7, the sleeve ports 38 may include a screen.

In other embodiments, the sleeve 36 does not include ports, and the valve 25 is opened by moving the sleeve 36 out of proximity of the set of ports 32 and closed by moving the sleeve 36 to cover the set of ports 32. In this embodiment, the sleeve 36 is moved between the open port position and closed port position by sliding or indexing axially. In other embodiments, the sleeve may be moved between the open port position and the closed port position by rotating the sleeve about the central axis of the housing 39. Furthermore, while this embodiment of the valve 25 includes a sleeve 36 arranged within the housing 39, in an alternative embodiment, the sleeve 36 may be located external of the housing 39.

Figure 3:
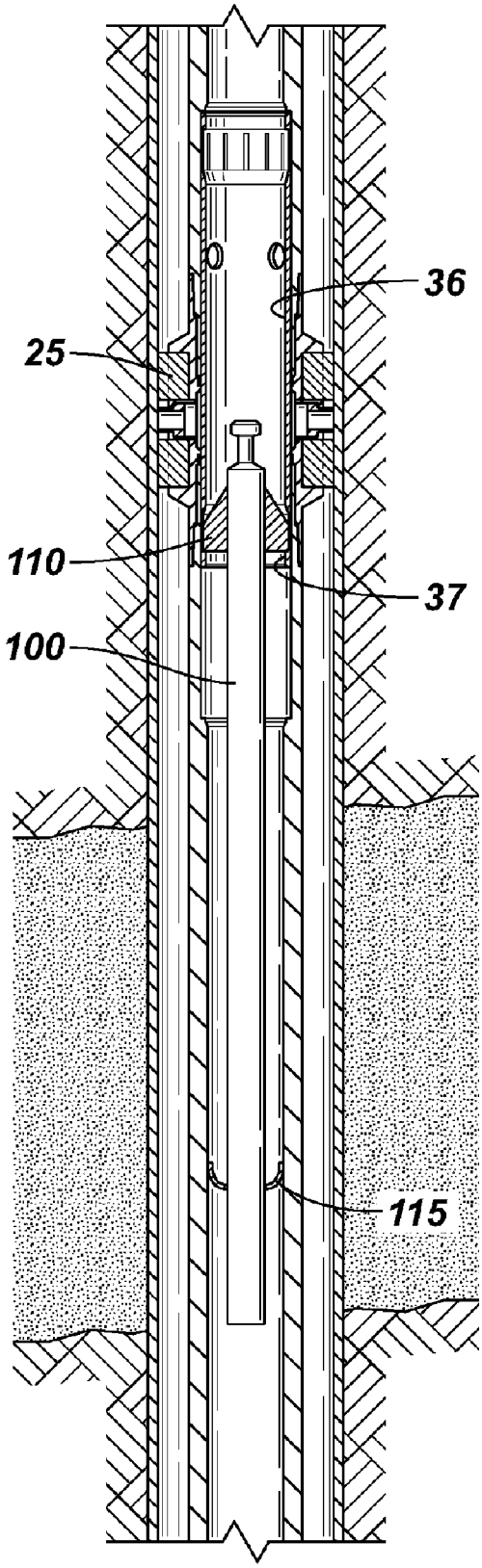
FIG. 3 illustrates an actuating device used to open a valve in a casing string disposed in a wellbore.

Actuation of the zonal communication valve are conventionally achieved by any number of mechanisms including darts, tool strings, control lines, and drop balls. FIG. 3 illustrates one embodiment of a dart for selectively actuating the valves of a well completion system. A dart 100 having a latching mechanism 110 (e.g., a collet) may be released into the casing string 20 and pumped downhole to engage a mating profile 37 formed in the sliding sleeve 36 of a valve 25. Once the dart 100 engages the sleeve, hydraulic pressure behind the dart 100 may be increased to a predetermined level to shift the sleeve between the open port position and the closed port position. The dart 100 may include one or more centralizers 115 (e.g., guiding fins). When the fluids are flow back uphole, the dart 100 will be floated up until it is stuck at a restriction above the valve 25. Then, the dart 100 may restrict the flow.

Embodiments of the present invention relate to improved actuating devices (e.g., darts) for controlling flows in a casing or any tubular completion system. Referring to FIG. 4, a completion system 300 in accordance with one embodiment of the invention may include a casing 200 having one or more zonal communication valves 201 and 202. The valves 201 and 202 may include any types of valves, for example, sliding sleeve valves, rotating sleeve valves, flapper valves, ball valves, etc. Note that although a completion system with a casing is used in this illustration, embodiments of the invention may be used with any tubular string.

Figure 4A:
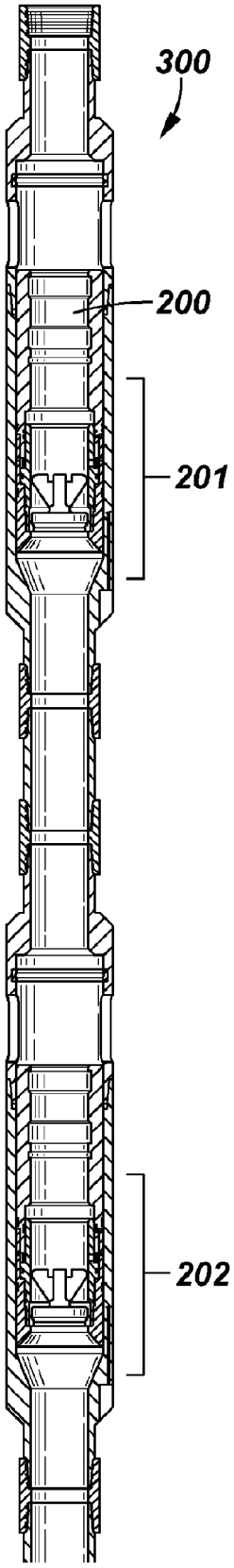
FIG. 4A shows a multiple valve casing string in accordance with one embodiment of the invention.
Figure 4B:
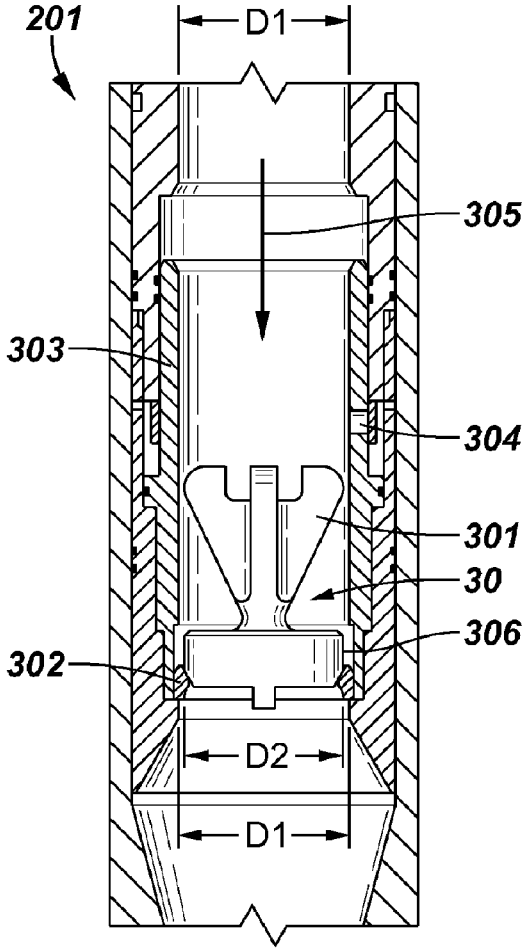
FIG. 4B shows an expanded view of one of the valves on the casing string of FIG. 4A.

As shown in FIG. 4A, casing 200 may include a plurality of control valves such as 201 and 202. FIG. 4B shows an enlarged illustration of one such control valve (e.g., 201 in FIG. 4A). As shown in FIG. 4B, the control valve 201 includes a sliding sleeve 303 that may be used to control the closing and opening of a port 304. As noted above, the sleeve 303 may control the closing and opening of the port 304 via an axial sliding action or via a rotation action.

Figure 4C:
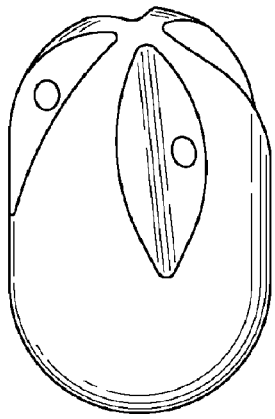
FIG. 4C shows an alternative example of an actuating device in accordance with one embodiment of the invention.

In the embodiment shown in FIG. 4B, an actuating device (e.g., a dart) 30 is used to control the movement of the sleeve 303 in order to control the opening and closing of the port 304. The dart 30 comprises two parts; a dart head 306 having a substantially disk-like or partial spherical shape, and a tail part having one or more fins (or void carved in a solid body) 301, wherein the fins or voids are preferably disposed substantially perpendicular to the disk-like or partial spherical structure. As will be explained below, the dart head 306 may function to seal off the fluid path and to push a sleeve that controls the valve. The fins 301 of the dart help to guide the dart down the casing. The main purpose of the fin or a void in the cylindrical/spherical shaped dart is to allow fluid or gas to flow around the dart when it is pumped uphole and lodged against a deploy seat about it. FIG. 4C shows an example of an actuating device that includes a partial spherical head and voids in the tail part. One of ordinary skill in the art would appreciate that embodiments of the invention are not limited to actuating devices having the above described shapes. For example, one may also have a disk-like head and voided tail or a partial spherical head and a finned tail.

When fluids are flowed from the surface downhole, i.e., in a direction 305, the dart 30 will be pushed down until it hits a seating member 302. The seating member may be a collet, an O-ring, a C-ring, or have other shapes. The ID of seating member 302 is controllable through an expansion and contraction motion. In the case of a C-ring, the seating member may have an open state shaped like a "C," and a closed state shaped like an "O."

The C-ring is initially in an open configuration having a larger inner diameter such that a dart may flow down to a control valve below. Afterwards, the C-ring may be closed to form an O-ring that has a smaller inner diameter such that a dart may not pass. The closing of the C-ring may be accomplished by any mechanism known in the art. For example, the closing of the C-ring may be accomplished by using a control (e.g., hydraulic) line to push a moveable part to force the C-ring to close to form an O-ring.

Alternatively, the ID of the seating member may be controlled through a signal received by a receiver connected to the seating member. Such a signal may be a radio frequency (RF) signal, an acoustic signal, a radioactive signal, a magnetic signal, or other types of signals. The signals may be sent from the surface or delivered by the darts. For example, the signal may be transmitted by a transmitter mounted on a dart. When the dart passes by a seating member, a command may be issued to contract the seating member.

In preferred embodiments, the C-ring may have an inner diameter similar to (or greater than) that of the casing inner diameter D1, such that a dart (which has a diameter D2 slightly smaller than the inner diameter of the casing) can pass through. Once closed, O-ring may have an inner diameter smaller than D1 and D2 such that a dart would not pass through. In some embodiments, the O-ring may become a seating member 302 or a part thereof.

Once the dart 30 seats on the seating member 302, the dart head 306 will form a seal with the seating member 302. The hydraulic pressure above the dart 30 then forces the dart 30 to push against the seating member 302, resulting in a downward movement of the sleeve 303, which in turn may lead to the opening (or closing—depending on the control valve design) of the port 304.

Once the port 304 is open, the treatment fluids may be flowed from the casing into the zone to be treated. In treating a multiple zone formations, after the treatment of the first zone, a C-ring above the first zone may be closed to form another seating member for the second zone. Another dart is flowed down to seat on the seating member for the second zone to open the second set of ports for the second zone. These processes may be repeated for all the zones to be treated.

Figure 5:
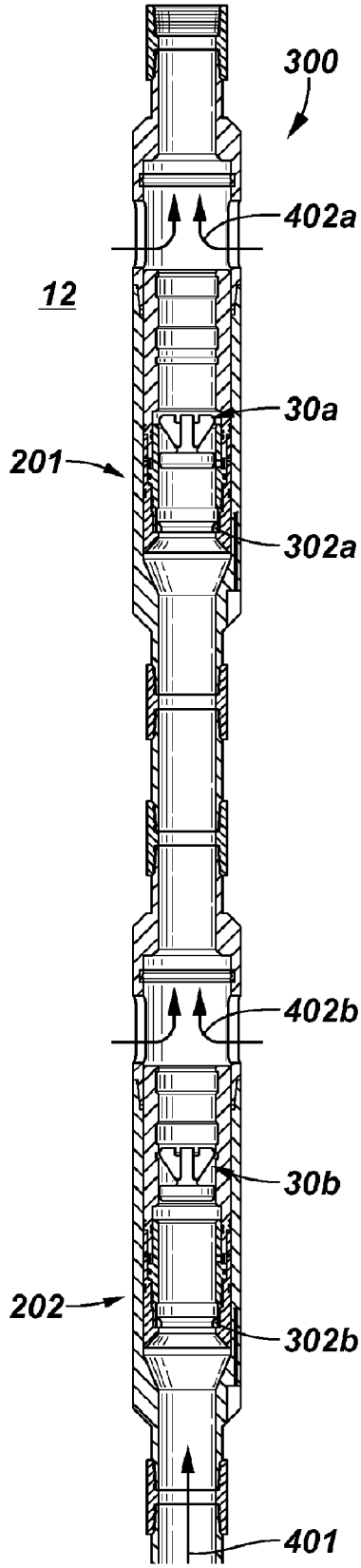
FIG. 5 shows a multiple valve casing string during flowing back or production.

When the treatments are complete, the well may be cleaned or flowed back, and the formation fluids may be produced. During flow back (e.g., clean up or production), the fluid flows are reversed. The Dart 30 will be pushed upward and lifted off the seating member 302. FIG. 5 illustrates a completion system 300 during a flow back. As shown in FIG. 5, two control valves 201, 202 each have a dart 30*a*, 30*b*. The darts 30*a*, 30*b* are lifted off the seating member 302*a*, 302*b* because the flow direction 401 is upward. The upward flow may result from flowing fluids from the formation 12 into the casing, as illustrated by flows 402*a*, 402*b*.

The darts may be lifted all the way up until they hit the seating members (or O-rings) above them. This is illustrated in FIG. 6B. As shown in FIG. 6B, a dart 30*b* is pushed up against a seating member 302*a* above it during a flow back. The fins 301 abut the seating member 302*a*. Because the fins 301 or voids do not form a seal with the seating member 302*a*, the fluids can flow by the fins 301 to continue the upward path. However, the dart head 306, being a disk, may obstruct the flow path. Therefore, a section of the casing 501 includes an enlarge internal diameter such that when the dart 30*b* is blocked by the seating member 302*a*, the dart head 306 is accommodated within this enlarged section 501. As a result, the dart head 306 will not completely block the fluid flow 502.

Figure 6A:
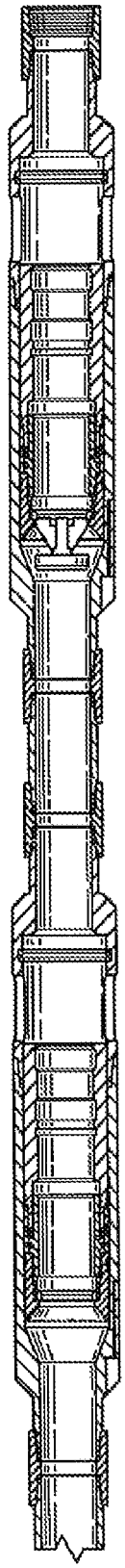
FIG. 6A shows an actuating device in accordance with one embodiment of the invention lodged at a C-ring or collet above during flow back.
Figure 6B:
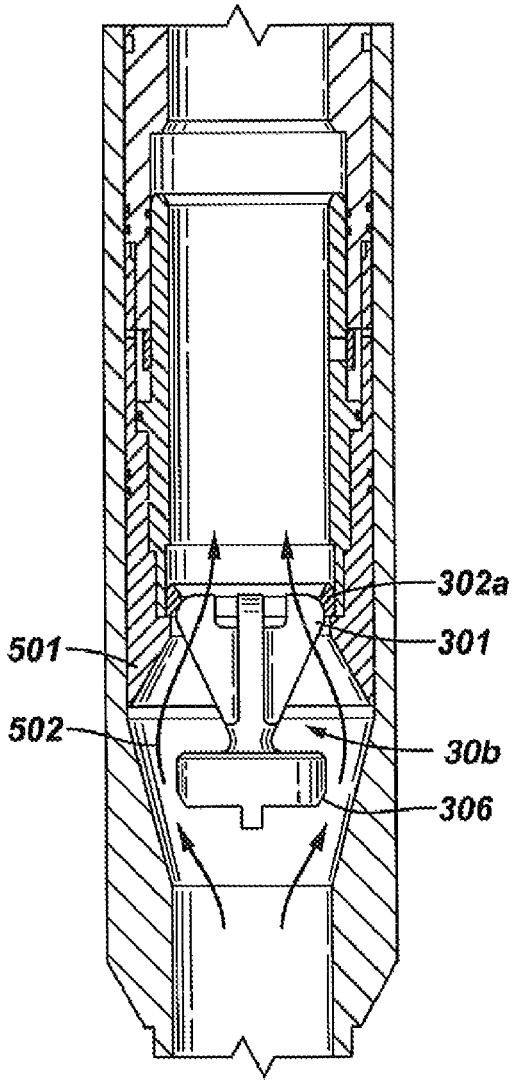
FIG. 6B shows an actuating device in accordance with one embodiment of the invention lodged at a C-ring or collet above during flow back.

With the design shown in FIGS. 6A and 6B, the darts may be allowed to remain in the casing during the flow back or productions. If desired, the darts may be made of materials (e.g., polymers, plastics, aluminum, or frangible materials) that can be degraded by chemical (.g., corrosion or dissolution) or physical means (e.g., drilling) such that the darts can be removed from the casing when they are no longer needed.

Advantages of the present invention may include one or more of the following. Embodiments of the invention have simple structures. The darts may be left in the system with little restriction of flows when the flow direction is reversed. the shape of the darts provides stabilized motion in the flow due to the stabilizing effect of the fins. Some embodiments of the invention may be easily removed if desired.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system for use in a wellbore having a plurality of well zones, comprising:

a tubing disposed in the wellbore; and a plurality of valves connected to the tubing, wherein each of the plurality of valves comprises at least one port for communication between the tubing and one of the plurality of well zones, wherein each of the plurality of valves further comprises a sleeve moveable by an actuating device between an open position, wherein the at least one port is open, and a closed position, wherein the at least one port is closed, wherein the actuating device comprises a head part and a tail part, the head part having a disk-like or partial spherical structure having a diameter slightly smaller than an internal diameter of the tubing and the tail part having at least one fin or void arranged substantially perpendicular to the disk-like or partial spherical structure; and wherein each valve comprises a seating member for blocking upward movement of the actuating device directly below.

2. The system of claim 1, wherein the tubing is a casing.

3. The system of claim 1, wherein the tubing includes at least one section having an enlarged diameter that is larger than the diameter of the disk-like or partial spherical structure of the actuating device.

4. The system of claim 1, wherein the disk-like or partial spherical structure of the actuating device is configured to seat on a seating member that is part of the sleeve, wherein the seating member has an internal bore diameter smaller than the diameter of the disk-like or partial spherical structure of the actuating device such that the disk-like or partial spherical structure of the actuating device can seal the internal bore of the seating member.

5. The system of claim 4, wherein the seating member comprises a C-ring or collet, which when in an open position has an internal bore diameter greater than the diameter of the disk-like or partial spherical structure of the actuating device such that the actuating device can pass through.

6. The system of claim 5, wherein the C-ring or collet when in a closed position forms the seating member.

7. The system of claim 1, wherein the sleeve controls the at least one port by sliding along an axial direction of the tubing.

8. The system of claim 1, wherein the sleeve comprises at least one port configured to match the at least one port on the control valve when in the open position.

9. The system of claim 1, wherein the sleeve comprises at least one screen configured to be aligned with the at least one port in the open position.

10. The system of claim 1, wherein the actuating device is made of a frangible material.

11. A method for treating a wellbore having a plurality of well zones, comprising:

disposing a tubing in the wellbore, wherein the tubing has a plurality of valves, each having at least one port for communication between the tubing and one of the plurality of well zones, wherein each of the plurality of valves further comprises a sleeve moveable between an open position, wherein the at least one port is open, and a closed position, wherein the at least one port is closed;

opening a first valve of the plurality of valves by moving a sleeve therein using an actuating device, wherein the actuating device comprises a head part and a tail part, the head part having a disk-like or partial spherical structure having a diameter slightly smaller than an internal diameter of the tubing and the tail part having at least one fin arranged substantially perpendicular to the disk-like or partial spherical structure, wherein the disk-like or partial spherical structure is configured to push a seating member on the sleeve to cause the opening of the first valve, the seating member of a second valve above the actuating device blocking upward movement of the actuating device;

flowing a fluid through the first valve; and structuring the actuating device such that when flowing the fluid through the tubing from below the actuating device, the actuating device allows the fluid to pass through to a position above the actuating device while the actuating device is against the seating member of the second valve.

12. The method of claim 11, wherein the tubing is a casing.

13. The method of claim 11, further comprising:

closing a C-ring in a sleeve to form a seating member above the first valve, opening a second valve of the plurality of valves by moving a sleeve in the second valve using another one of the actuating device; and flowing a fluid through the second valve.

14. The method of claim 11, wherein the tubing includes at least one section having an enlarged diameter that is larger than the diameter of the disk-like or partial spherical structure of the actuating device.

15. The method of claim 11, wherein the sleeve controls the first valve by sliding along an axial direction of the tubing.

16. A method for flowing a fluid uphole from a wellbore having a plurality of well zones, comprising:

disposing a casing in the wellbore, wherein the casing has a plurality of valves, each having at least one port for communication between the casing and one of the plurality of well zones, wherein each of the plurality of valves further comprises a sleeve moveable between an open position, wherein the at least one port is open, and a closed position, wherein the at least one port is closed;

opening at least one valve of the plurality of valves by moving a sleeve therein using an actuating device, wherein the actuating device comprises a head part and a tail part, the head part having a disk-like or partial spherical structure having a diameter slightly smaller than an internal diameter of the tubing and the tail part having at least one fin arranged substantially perpendicular to the disk-like or partial spherical structure, wherein the disk-like or partial spherical structure is configured to push a seating member on the sleeve to cause the opening of the at least one valve; and flowing fluid through the at least one valve into the casing and uphole, wherein each valve comprises a seating member for blocking upward movement of the actuating device directly below; and wherein the casing has at least one section having an enlarged diameter such that the fluid can flow by the disk-like or partial spherical structure when located in the at least one section having the enlarged inner diameter.

17. The method of claim 16, wherein the fluid comprises hydrocarbons from one of the plurality of well zones.

* * * * *